US011756560B2

(12) United States Patent
Grancharov et al.

(10) Patent No.: US 11,756,560 B2
(45) **Date of Patent: *Sep. 12, 2023**

(54) FILLING OF NON-CODED SUB-VECTORS IN TRANSFORM CODED AUDIO SIGNALS

(71) Applicant: Telefonaktiebolaget LM Ericsson (publ), Stockholm (SE)

(72) Inventors: Volodya Grancharov, Solna (SE); Sebastian Näslund, Solna (SE); Sigurdur Sverrisson, Kungsängen (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 0 days.

This patent is subject to a terminal disclaimer.

(21) Appl. No.: 18/079,088

(22) Filed: Dec. 12, 2022

(65) Prior Publication Data

US 2023/0106557 A1 Apr. 6, 2023

Related U.S. Application Data

(63) Continuation of application No. 17/333,400, filed on May 28, 2021, now Pat. No. 11,551,702, which is a (Continued)

(51) Int. Cl.
*G10L 19/02* (2013.01)
*G10L 21/038* (2013.01)
(Continued)

(52) U.S. Cl.
CPC ..... *G10L 19/02* (2013.01); *G10L 19/028* (2013.01); *G10L 19/0212* (2013.01);
(Continued)

(58) Field of Classification Search
USPC ..... 704/500–504
See application file for complete search history.

(56) References Cited

U.S. PATENT DOCUMENTS 5,799,131 A 8/1998 Taniguchi et al.
6,952,671 B1 10/2005 Kolesnik et al.
(Continued)

FOREIGN PATENT DOCUMENTS

CN 101809657 A 8/2010
EP 2048787 A1 4/2009
(Continued)

OTHER PUBLICATIONS

Mehrotra, Sanjeev , et al., "Hybrid Low Bitrate Audio Coding Using Adaptive Gain Shape Vector Quantization", 2008 IEEE 10 Workshop on Multimedia Signal Processing, Piscataway, New Jersey, US, Oct. 8, 2008, 927-932.
(Continued)

*Primary Examiner* — Leonard Saint-Cyr
(74) *Attorney, Agent, or Firm* — Murphy, Bilak & Homiller, PLLC

(57) ABSTRACT

A spectrum filler for filling non-coded residual sub-vectors of a transform coded audio signal includes a sub-vector compressor configured to compress actually coded residual sub-vectors. A sub-vector rejecter is configured to reject compressed residual sub-vectors that do not fulfill a predetermined sparseness criterion. A sub-vector collector is configured to concatenate the remaining compressed residual sub-vectors to form a first virtual codebook. A coefficient combiner is configured to combine pairs of coefficients of the first virtual codebook to form a second virtual codebook. A sub-vector filler is configured to fill non-coded residual sub-vectors below a predetermined frequency with coefficients from the first virtual codebook, and to fill non-coded residual sub-vectors above the predetermined frequency with coefficients from the second virtual codebook.

18 Claims, 13 Drawing Sheets

Related U.S. Application Data continuation of application No. 15/941,566, filed on Mar. 30, 2018, now abandoned, which is a continuation of application No. 15/210,505, filed on Jul. 14, 2016, now Pat. No. 9,966,082, which is a continuation of application No. 14/003,820, filed as application No. PCT/SE2011/051110 on Sep. 14, 2011, now Pat. No. 9,424,856.

(60) Provisional application No. 61/451,363, filed on Mar. 10, 2011.

(51) Int. Cl.
*G10L 19/028* (2013.01)
*G10L 19/038* (2013.01)
*G10L 19/00* (2013.01)

(52) U.S. Cl.
CPC ..... *G10L 19/038* (2013.01); *G10L 21/038* (2013.01); *G10L 2019/0007* (2013.01)

(56) References Cited

U.S. PATENT DOCUMENTS

| | | | |
|---|---|---|---|
| 8,619,918 | B2 | 12/2013 | Khojastepour et al. |
| 2002/0007269 | A1 | 1/2002 | Gao |
| 2002/0080408 | A1 | 6/2002 | Budge et al. |
| 2003/0233234 | A1 | 12/2003 | Truman et al. |
| 2004/0008778 | A1 | 1/2004 | Yang et al. |
| 2005/0053300 | A1 | 3/2005 | Mukerjee |
| 2008/0025633 | A1 | 1/2008 | Szeliski |
| 2008/0170623 | A1 | 7/2008 | Aharon et al. |
| 2009/0198491 | A1 | 8/2009 | Sato et al. |
| 2009/0299738 | A1 | 12/2009 | Sato et al. |
| 2010/0215081 | A1 | 8/2010 | Bajwa et al. |
| 2010/0241437 | A1 | 9/2010 | Taleb et al. |

FOREIGN PATENT DOCUMENTS

| | | | |
|---|---|---|---|
| EP | 2234104 | A1 | 9/2010 |
| WO | 0011657 | A1 | 3/2000 |

OTHER PUBLICATIONS

Mittal , et al., "Low Complexity Factorial Pulse Coding of MDCT Coefficients Using Approximation of Combinatorial Functions", Mittal, et al. "Low Complexity Factorial Pulse Coding of MDCT Coefficients Using Approximation of Combinatorial Functions." IEEE 1-1244-0728-1/07. ICASSP. 2007. pp. 1-4.

"Series G: Transmission Systems and Media, Digital Systems and Networks; Digital terminal equipments—Coding of analogue signals: Low-complexity, full-band audio coding for high-quality, conversational applications", ITU-T; Telecommunication Standardization Sector of ITU, G.719.

FILLING OF NON-CODED SUB-VECTORS IN TRANSFORM CODED AUDIO SIGNALS

RELATED APPLICATIONS

This application is a continuation of pending U.S. patent application Ser. No. 17/333,400 filed 28 May 2021, which is a continuation of U.S. patent application Ser. No. 15/941·566, filed 30 Mar. 2018, now abandoned, which is a continuation of U.S. patent application Ser. No. 15/210,505, filed 14 Jul. 2016 and issued as U.S. Pat. No. 9,966,082 B2, which is a continuation of U.S. patent application Ser. No. 14/003,820, filed 9 Sep. 2013 and issued as U.S. Pat. No. 9,424,856 B2, which is a national stage entry of PCT/SE2011/051110, filed 14 Sep. 2011, which claims priority to U.S. Provisional Application Ser. No. 61/451,363, filed 10 Mar. 2011. The entire contents of each aforementioned application is incorporated herein by reference.

TECHNICAL FIELD

The present technology relates to coding of audio signals, and especially to filling of non-coded sub-vectors in transform coded audio signals.

BACKGROUND

A typical encoder/decoder system based on transform coding is illustrated in FIG. 1.

Major steps in transform coding are:

A. Transform a short audio frame (20-40 milliseconds) to a frequency domain, e.g., through the Modified Discrete Cosine Transform (MDCT).

B. Split the MDCT vector X(k) into multiple bands (sub-vectors SV1, SV2, . . . ), as illustrated in FIG. 2. Typically, the width of the bands increases towards higher frequencies [1].

C. Calculate the energy in each band. This gives an approximation of the spectrum envelope, as illustrated in FIG. 3.

D. The spectrum envelope is quantized, and the quantization indices are transmitted to the decoder.

E. A residual vector is obtained by scaling the MDCT vector with the envelope gains, e.g., the residual vector is formed by the MDCT sub-vectors (SV1, SV2, . . . ) scaled to unit Root-Mean-Square (RMS) energy.

F. Bits for quantization of different residual sub-vectors are assigned based on envelope energies. Due to a limited bit budget, some of the sub-vectors are not assigned any bits. This is illustrated in FIG. 4, where sub-vectors corresponding to envelope gains below a threshold TH are not assigned any bits.

G. Residual sub-vectors are quantized according to the assigned bits, and quantization indices are transmitted to the decoder. Residual quantization can, for example, be performed with the Factorial Pulse Coding (FPC) scheme [2].

H. Residual sub-vectors with zero bits assigned are not coded, but instead noise-filled at the decoder. This is achieved by creating a Virtual Codebook (VC) from coded sub-vectors by concatenating the perceptually relevant coefficients of the decoded spectrum. The VC creates content in the non-coded residual sub-vectors.

I. At the decoder, the MDCT vector is reconstructed by up-scaling residual sub-vectors with corresponding envelope gains, and the inverse MDCT is used to reconstruct the time-domain audio frame.

A drawback of the conventional noise-fill scheme, e.g., as in [1], is that it in step H creates audible distortion in the reconstructed audio signal when used with the FPC scheme.

SUMMARY

A general object is an improved filling of non-coded residual sub-vectors of a transform coded audio signal.

Another object is the generation of virtual codebooks used to fill the non-coded residual sub-vectors.

These objects are achieved in accordance with the attached claims.

A first aspect of the present technology involves a method of filling non-coded residual sub-vectors of a transform coded audio signal. The method includes the steps:

- Compressing actually coded residual sub-vectors.
- Rejecting compressed residual sub-vectors that do not fulfill a predetermined sparseness criterion.
- Concatenating the remaining compressed residual sub-vectors to form a first virtual codebook.
- Combining pairs of coefficients of the first virtual codebook to form a second virtual codebook.
- Filling non-coded residual sub-vectors below a predetermined frequency with coefficients from the first virtual codebook.
- Filling non-coded residual sub-vectors above the predetermined frequency with coefficients from the second virtual codebook.

A second aspect of the present technology involves a method of generating a virtual codebook for filling non-coded residual sub-vectors of a transform coded audio signal below a predetermined frequency. The method includes the steps:

- Compressing actually coded residual sub-vectors.
- Rejecting compressed residual sub-vectors that do not fulfill a predetermined sparseness criterion.
- Concatenating the remaining compressed residual sub-vectors to form the virtual codebook.

A third aspect of the present technology involves a method of generating a virtual codebook for filling non-coded residual sub-vectors of a transform coded audio signal above a predetermined frequency. The method includes the steps:

- Generating a first virtual codebook in accordance with the second aspect.
- Combining pairs of coefficients of the first virtual codebook.

A fourth aspect of the present technology involves a spectrum filler for filling non-coded residual sub-vectors of a transform coded audio signal. The spectrum filler includes:

- A sub-vector compressor configured to compress actually coded residual sub-vectors.
- A sub-vector rejecter configured to reject compressed residual sub-vectors that do not fulfill a predetermined sparseness criterion.
- A sub-vector collector configured to concatenate the remaining compressed residual sub-vectors to form a first virtual codebook.
- A coefficient combiner configured to combine pairs of coefficients of the first virtual codebook to form a second virtual codebook.
- A sub-vector filler configured to fill non-coded residual sub-vectors below a predetermined frequency with coefficients from the first virtual codebook and to fill non-coded residual sub-vectors above the predetermined frequency with coefficients from the second virtual codebook.

A fifth aspect of the present technology involves a decoder including a spectrum filler in accordance with the fourth aspect.

A sixth aspect of the present technology involves a user equipment including a decoder in accordance with the fifth aspect.

A seventh aspect of the present technology involves a low frequency virtual codebook generator for generating a low frequency virtual codebook for filling non-coded residual sub-vectors of a transform coded audio signal below a predetermined frequency. The low frequency virtual codebook generator includes:

- A sub-vector compressor configured to compress actually coded residual sub-vectors.
- A sub-vector rejecter configured to reject compressed residual sub-vectors that do not fulfill a predetermined sparseness criterion.
- A sub-vector collector configured to concatenate the remaining compressed residual sub-vectors to form the low frequency virtual codebook.

An eighth aspect of the present technology involves a high frequency virtual codebook generator for generating a high frequency virtual codebook for filling non-coded residual sub-vectors of a transform coded audio signal above a predetermined frequency. The low frequency virtual codebook generator includes:

- A low frequency virtual codebook generator in accordance with the seventh aspect configured to generate a low frequency virtual codebook.
- A coefficient combiner configured to combine pairs of coefficients of the low frequency virtual codebook to form the high frequency virtual codebook.

An advantage of the present spectrum filling technology is a perceptual improvement of decoded audio signals compared to conventional noise filling.

BRIEF DESCRIPTION OF THE DRAWINGS

The present technology, together with further objects and advantages thereof, may best be understood by referring to the following description taken together with the accompanying drawings, in which.

DETAILED DESCRIPTION

Before the present technology is described in more detail, transform based coding/decoding will be briefly described with reference to FIGS. 1-7.

Figure 1:
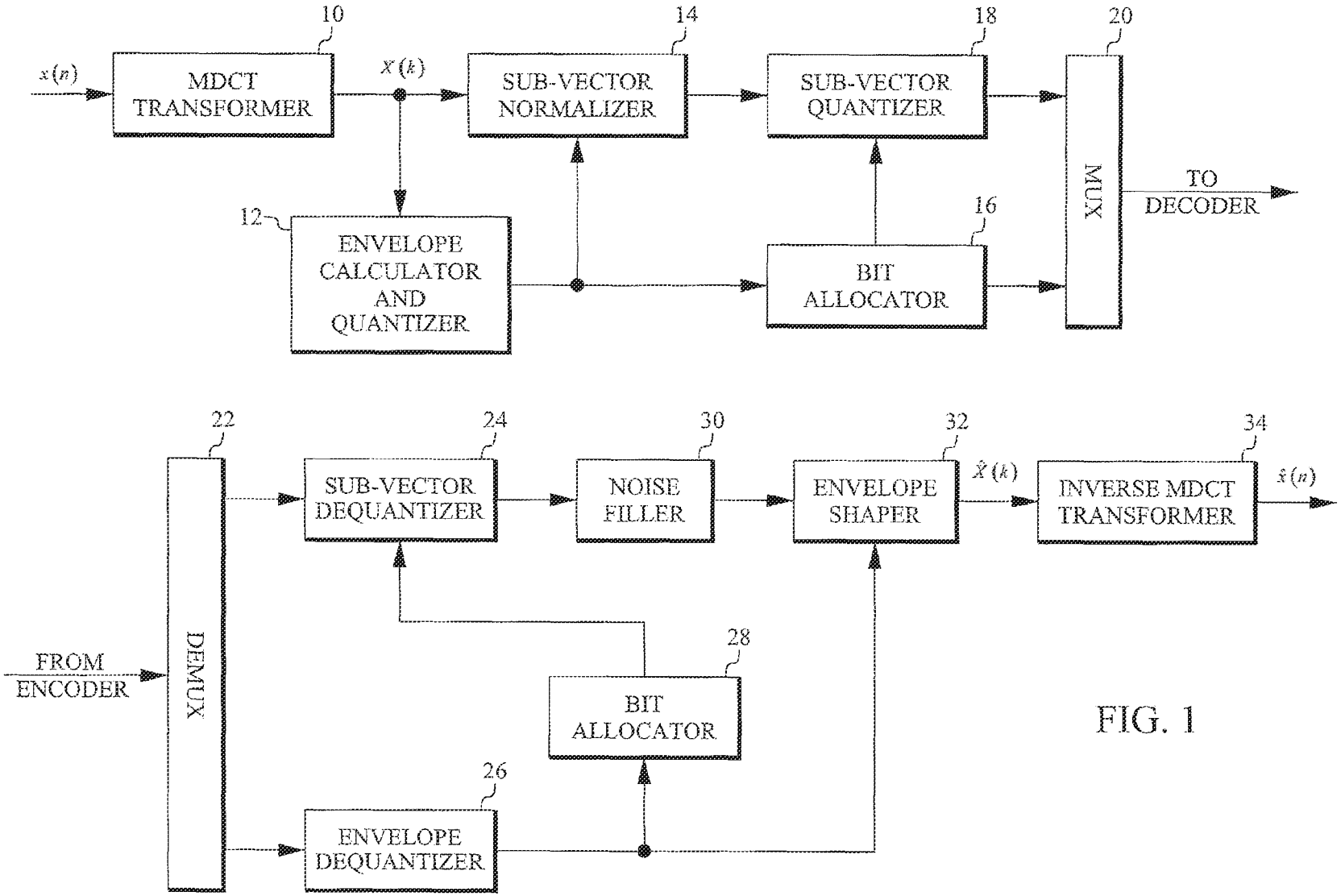
FIG. 1 is a block diagram illustrating a typical transform based audio coding/decoding system.
Figure 2:
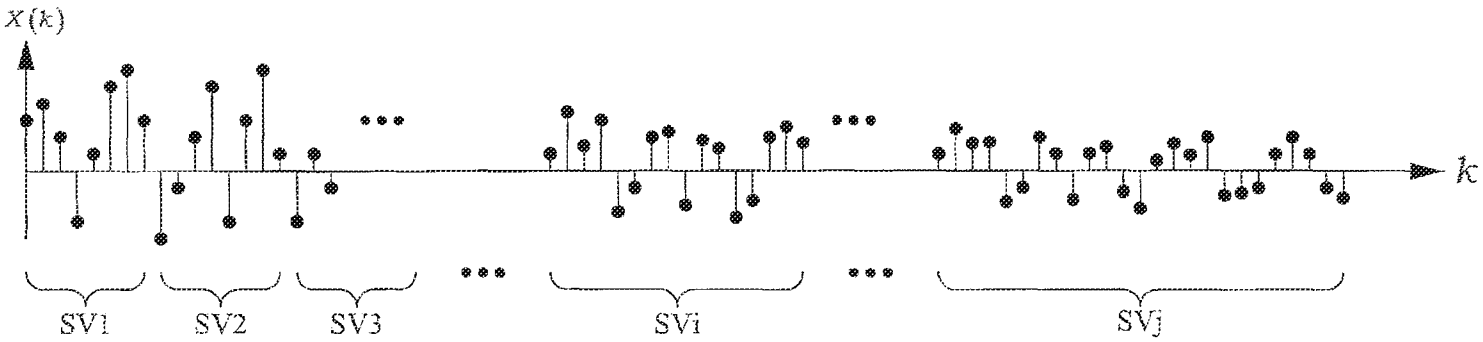
FIG. 2 is a diagram illustrating the structure of an MDCT vector.
Figure 3:
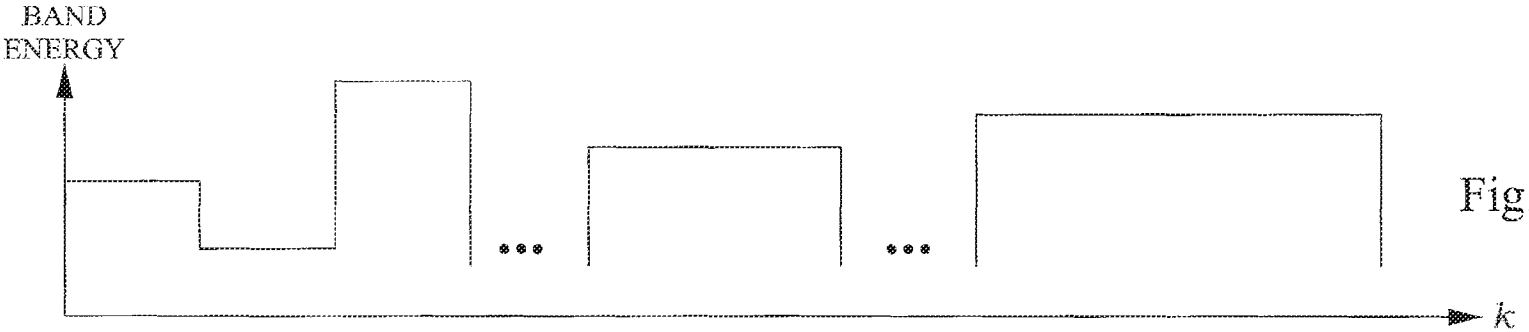
FIG. 3 is a diagram illustrating the energy distribution in the sub-vectors of an MDCT vector.

FIG. 1 is a block diagram illustrating a typical transform based audio coding/decoding system. An input signal x(n) is forwarded to a frequency transformer, for example, an MDCT transformer 10, where short audio frames (20-40 milliseconds) are transformed into a frequency domain. The resulting frequency domain signal X(k) is divided into multiple bands (sub-vectors SV1, SV2, . . . ), as illustrated in FIG. 2. Typically, the width of the bands increases towards higher frequencies [1]. The energy of each band is determined in an envelope calculator and quantizer 12. This gives an approximation of the spectrum envelope, as illustrated in FIG. 3. Each sub-vector is normalized into a residual sub-vector in a sub-vector normalizer 14 by scaling with the inverse of the corresponding quantized envelope value (gain).

Figure 4:
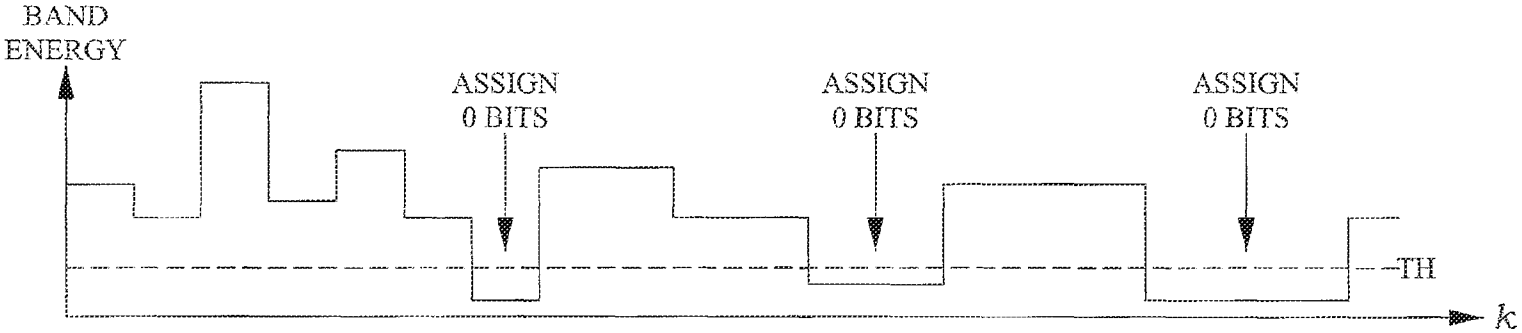
FIG. 4 is a diagram illustrating the use of the spectrum envelope for bit allocation.

A bit allocator 16 assigns bits for quantization of different residual sub-vectors based on envelope energies. Due to a limited bit-budget, some of the sub-vectors are not assigned any bits. This is illustrated in FIG. 4, where sub-vectors corresponding to envelope gains below a threshold TH are not assigned any bits. Residual sub-vectors are quantized in a sub-vector quantizer 18 according to the assigned bits. Residual quantization can, for example, be performed with the Factorial Pulse Coding (FPC) scheme [2]. Residual sub-vector quantization indices and envelope quantization indices are then transmitted to the decoder over a multiplexer (MUX) 20.

At the decoder the received bit stream is de-multiplexed into residual sub-vector quantization indices and envelope quantization indices in a de-multiplexer (DEMUX) 22. The residual sub-vector quantization indices are dequantized into residual sub-vectors in a sub-vector dequantizer 24, and the envelope quantization indices are dequantized into envelope gains in an envelope dequantizer 26. A bit allocator 28 uses the envelope gains to control the residual sub-vector dequantization.

Residual sub-vectors with zero bits assigned have not been coded at the encoder and are instead noise-filled by a noise filler 30 at the decoder. This is achieved by creating a Virtual Codebook (VC) from coded sub-vectors by concatenating the perceptually relevant coefficients of the decoded spectrum ([1] section 8.4.1). Thus, the VC creates content in the non-coded residual sub-vectors.

At the decoder, the MDCT vector $\hat{x}(n)$ is then reconstructed by up-scaling residual sub-vectors with corresponding envelope gains in an envelope shaper 32 and transforming the resulting frequency domain vector $\hat{X}(k)$ in an inverse MDCT transformer 34.

A drawback of the conventional noise-fill scheme described above is that it creates audible distortion in the reconstructed audio signal when used with the FPC scheme. The main reason is that some of the coded vectors may be too sparse, which creates energy mismatch problems in the noise-filled bands. Additionally, some of the coded vectors may contain too much structure (color), which leads to perceptual degradations when the noise-fill is performed at high frequencies.

The following description will focus on an embodiment of an improved procedure for virtual codebook generation in step H above.

Figure 5:
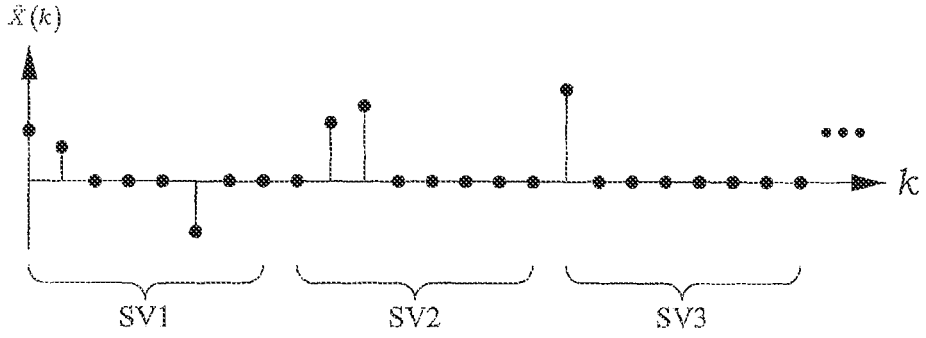
FIG. 5 is a diagram illustrating a coded residual.
Figure 6:
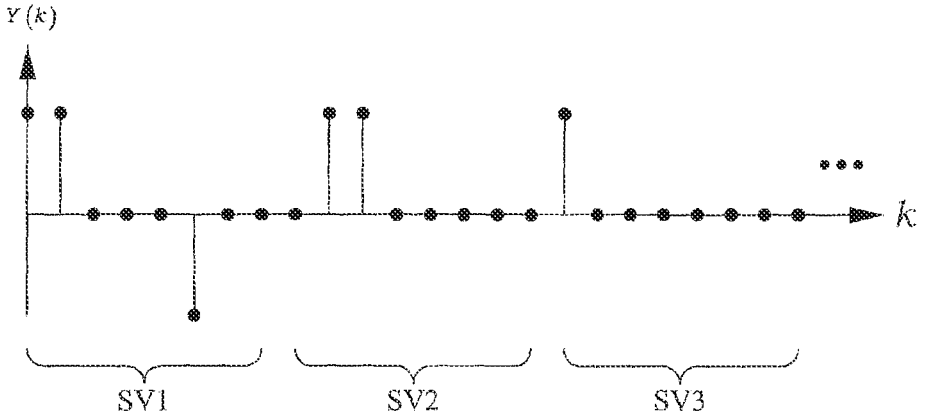
FIG. 6 is a diagram illustrating compression of a coded residual.

A coded residual $\hat{X}(k)$, illustrated in FIG. 5, is compressed or quantized according to:

$$Y(k) = \begin{cases} 1 \text{ if } \hat{X}(k) > 0 \\ 0 \text{ if } \hat{X}(k) = 0 \\ -1 \text{ if } \hat{X}(k) < 0 \end{cases} \tag{1}$$

as illustrated in FIG. 6. This step guarantees that there will be no excessive structure (such as periodicity at high-frequencies) in the noise-filled regions. In addition, the specific form of compressed residual Y(k) allows a low complexity in the following steps.

As an alternative the coded residual $\hat{X}(k)$ may be compressed or quantized according to:

$$Y(k) = \begin{cases} 1 \text{ if } \hat{X}(k) > T \\ 0 \text{ if } -T \le \hat{X}(k) \le T \\ -1 \text{ if } \hat{X}(k) < -T \end{cases} \tag{2}$$

where T is a small positive number. The value of T may be used to control the amount of compression. This embodiment is also useful for signals that have been coded by an encoder that quantizes symmetrically around 0 but does not include the actual value 0.

Figure 7:
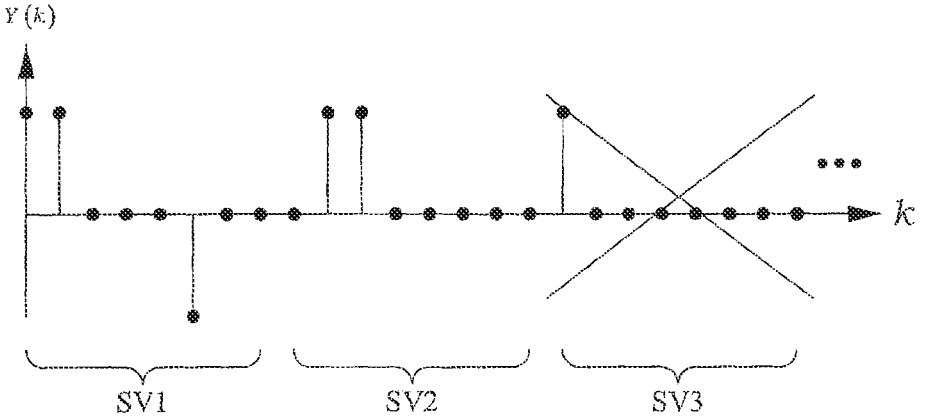
FIG. 7 is a diagram illustrating rejection of coded residual sub-vectors.
Figure 8:
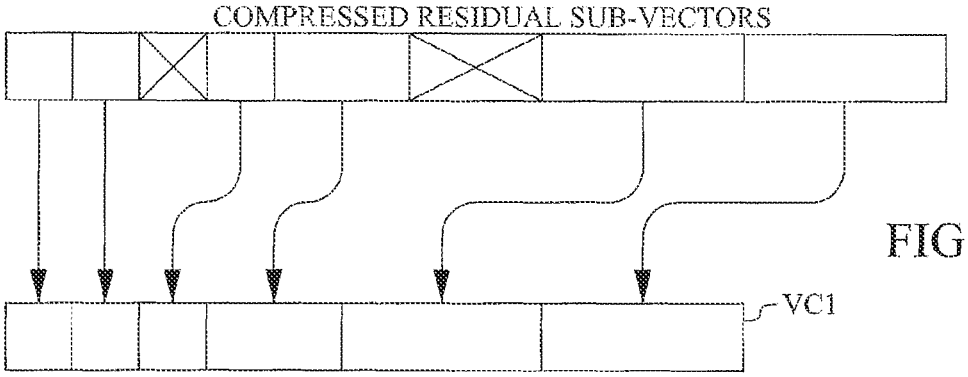
FIG. 8 is a diagram illustrating concatenation of surviving residual sub-vectors to form a first virtual codebook.

The virtual codebook is built only from "populated" M-dimensional sub-vectors. If a coded residual sub-vector does not fulfill the criterion:

$$\sum_{k=1}^{M} |Y(k)| \ge 2 \tag{3}$$

it is considered sparse and is rejected. For example, if the sub-vector has dimension 8 (M=8), equation (3) guarantees that a particular sub-vector will be rejected from the virtual codebook if it has more than 6 zeros. This is illustrated in FIG. 7, where sub-vector SV3 is rejected, since it has 7 zeros. A virtual codebook VC1 is formed by concatenating the remaining or surviving sub-vectors, as illustrated in FIG. 8. Since the length of the sub-vectors is a multiple of M, the criterion (3) may also be used for longer sub-vectors. In this case, the parts that do not fulfill the criterion are rejected.

In general, a compressed sub-vector is considered "populated" if it contains more that 20-30% of non-zero components. In the example above with M=8, the criterion is "more than 25% of non-zero components".

A second virtual codebook VC2 is created from the obtained virtual codebook VC1. This second virtual codebook VC2 is even more "populated" and is used to fill frequencies above 4.8 kHz (other transition frequencies are of course also possible; typically, the transition frequency is between 4 and 6 kHz). The second virtual codebook VC2 is formed in accordance with:

$$Z(k)=Y(k)\oplus Y(N-k),\ k=0 \ldots N-1 \tag{4}$$

where N is the size (total number of coefficients Y(k)) of the first virtual codebook VC1, and the combining operation $\oplus$ is defined as:

$$Z(k) = \begin{cases} \text{sign}(Y(k)) \times (|Y(k)| + |Y(N-k)|) \text{ if } Y(k) \ne 0 \\ Y(N-k) \text{ if } Y(k) = 0 \end{cases} \tag{5}$$

Figure 9A:
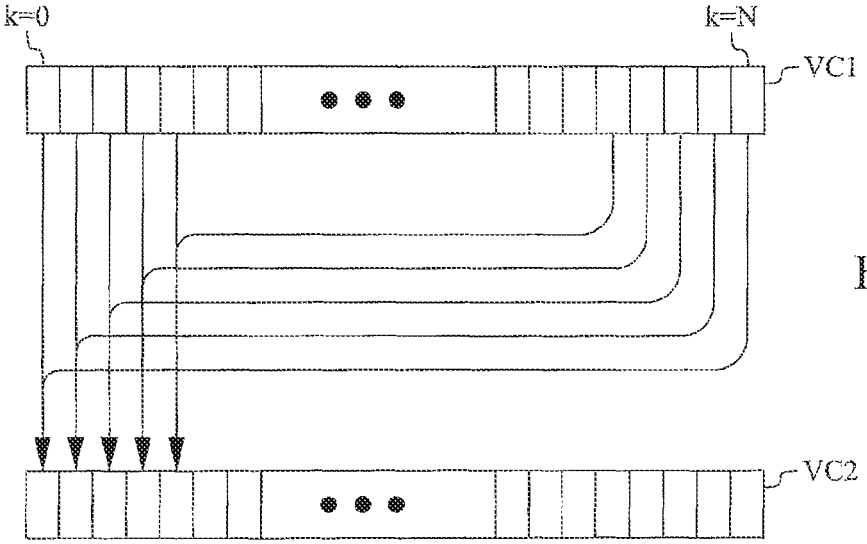
FIG. 9A-B are diagrams illustrating combining of coefficients from the first virtual codebook to form a second virtual codebook.
Figure 9B:
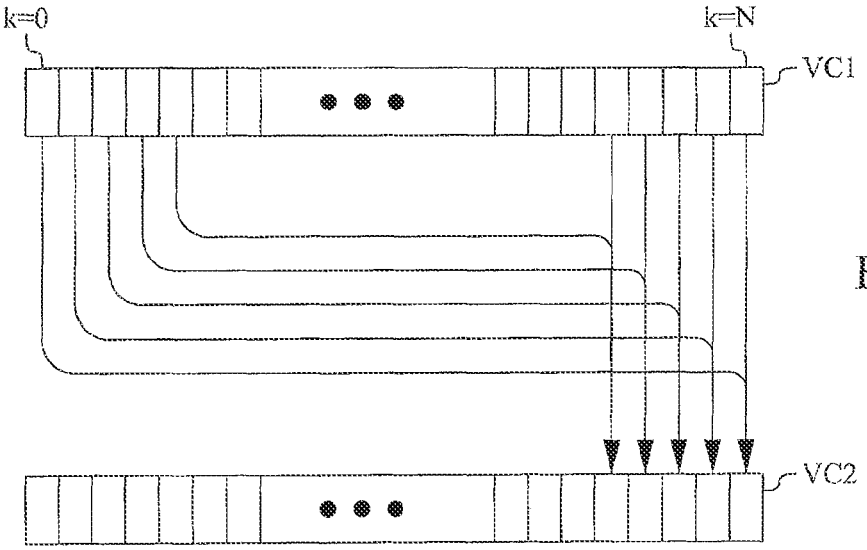

This combining or merging step is illustrated in FIG. 9A-B. It is noted that the same pair of coefficients Y(k), Y(N−k) is used twice in the merging process, once in the lower half (FIG. 9A) and once in the upper half (FIG. 9B).

Non-coded sub-vectors may be filled by cyclically stepping through the respective virtual codebook, VC1 or VC2 depending on whether the sub-vector to be filled is below or above the transition frequency and copying the required number of codebook coefficients to the empty sub-vector. Thus, if the codebooks are short and there are many sub-vectors to be filled, the same coefficients will be reused for filling more than one sub-vector.

An energy adjustment of the filled sub-vectors is preferably performed on a sub-vector basis. It accounts for the fact that after the spectrum filling the residual sub-vectors may not have the expected unit RMS energy. The adjustment may be performed in accordance with:

$$D(k) = \frac{\alpha}{\sqrt{\frac{1}{M}\sum_{k=1}^{M} Z(k)^2}} Z(k) \tag{6}$$

where $\alpha \le 1$, for example $\alpha=0.8$, is a perceptually optimized attenuation factor. A motivation for the perceptual attenuation is that the noise-fill operation often results in significantly different statistics of the residual vector and it is desirable to attenuate such "inaccurate" regions.

In a more advanced scheme energy adjustment of a particular sub-vector can be adapted to the type of neighboring sub-vectors: If the neighboring regions are coded at high-bitrate, attenuation of the current sub-vector is more aggressive (alpha goes towards zero). If the neighboring regions are coded at a low-bitrate or noise-filled, attenuation of the current sub-vector is limited (alpha goes towards one). This scheme prevents attenuation of large continuous spectral regions, which might lead to audible loudness loss. At the same time if the spectral region to be attenuated is narrow, even a very strong attenuation will not affect the overall loudness.

The described technology provides improved noise-filling. Perceptual improvements have been measured by means of listening tests. These tests indicate that the spectrum fill procedure described above was preferred by listeners in 83% of the tests while the conventional noise fill procedure was preferred in 17% of the tests.

Figure 10:
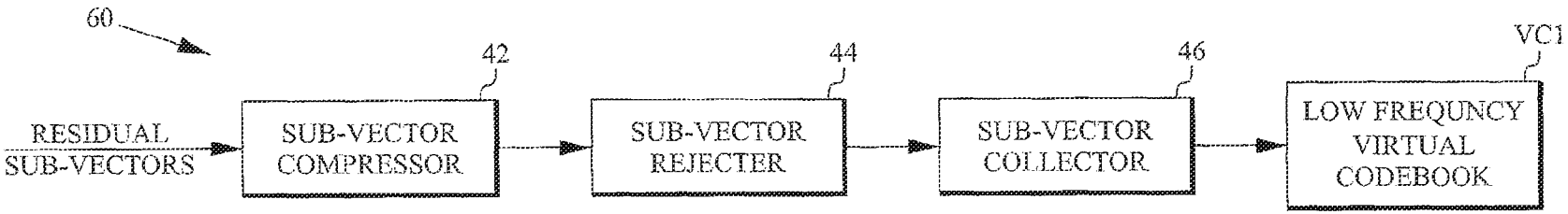
FIG. 10 is a block diagram illustrating an example embodiment of a low frequency virtual codebook generator.

FIG. 10 is a block diagram illustrating an example embodiment of a low frequency virtual codebook generator 60. Residual sub-vectors are forwarded to a sub-vector compressor 42, which is configured to compress actually coded residual sub-vectors (i.e., sub-vectors that have actually been allocated bits for coding), for example in accordance with equation (1). The compressed sub-vectors are forwarded to a sub-vector rejecter 44, which is configured to reject compressed residual sub-vectors that do not fulfill a predetermined sparseness criterion, for example criterion (3). The remaining compressed sub-vectors are collected in a sub-vector collector 46, which is configured to concatenate them to form the low frequency virtual codebook VC1.

Figure 11:
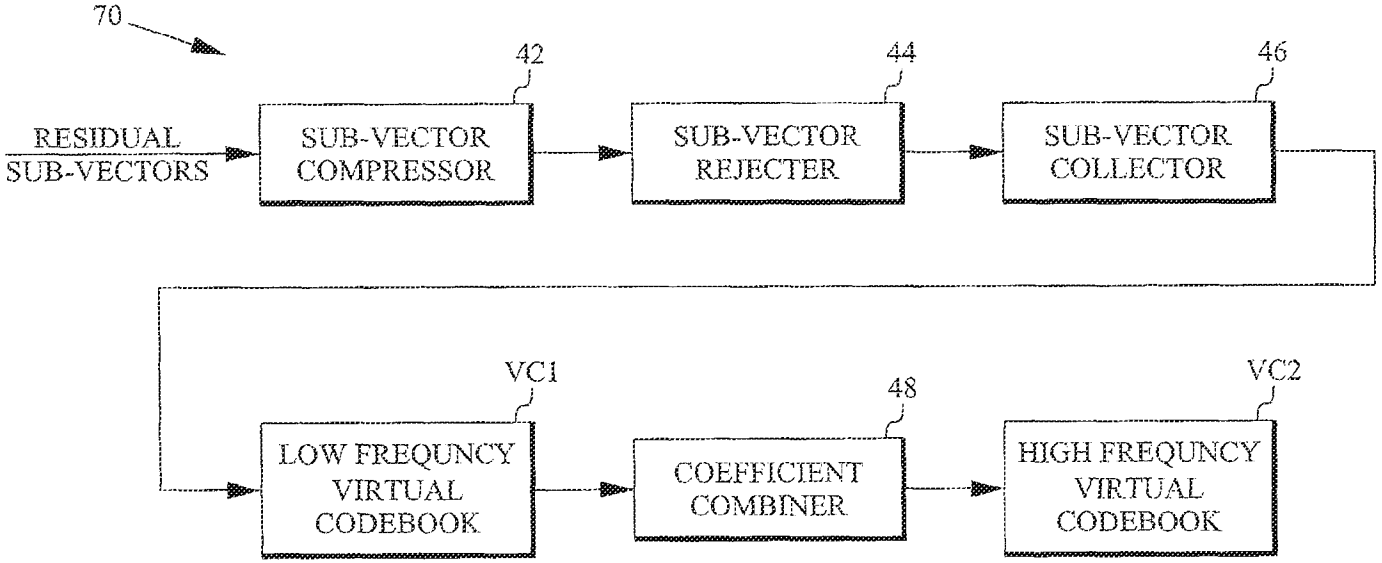
FIG. 11 is a block diagram illustrating an example embodiment of a high frequency virtual codebook generator.

FIG. 11 is a block diagram illustrating an example embodiment of a high frequency virtual codebook generator 70. Residual sub-vectors are forwarded to a sub-vector compressor 42, which is configured to compress actually coded residual sub-vectors (i.e., sub-vectors that have actually been allocated bits for coding), for example in accordance with equation (1). The compressed sub-vectors are forwarded to a sub-vector rejecter 44, which is configured to reject compressed residual sub-vectors that do not fulfill a predetermined sparseness criterion, for example criterion (3). The remaining compressed sub-vectors are collected in a sub-vector collector 46, which is configured to concatenate them to form the low frequency virtual codebook VC1. Thus, up to this point the high frequency virtual codebook generator 70 includes the same elements as the low frequency virtual codebook generator 60. Coefficients from the low frequency virtual codebook VC1 are forwarded to a coefficient combiner 48, which is configured to combine pairs of coefficients to form the high frequency virtual codebook VC2, for example in accordance with equation (5).

Figure 12:
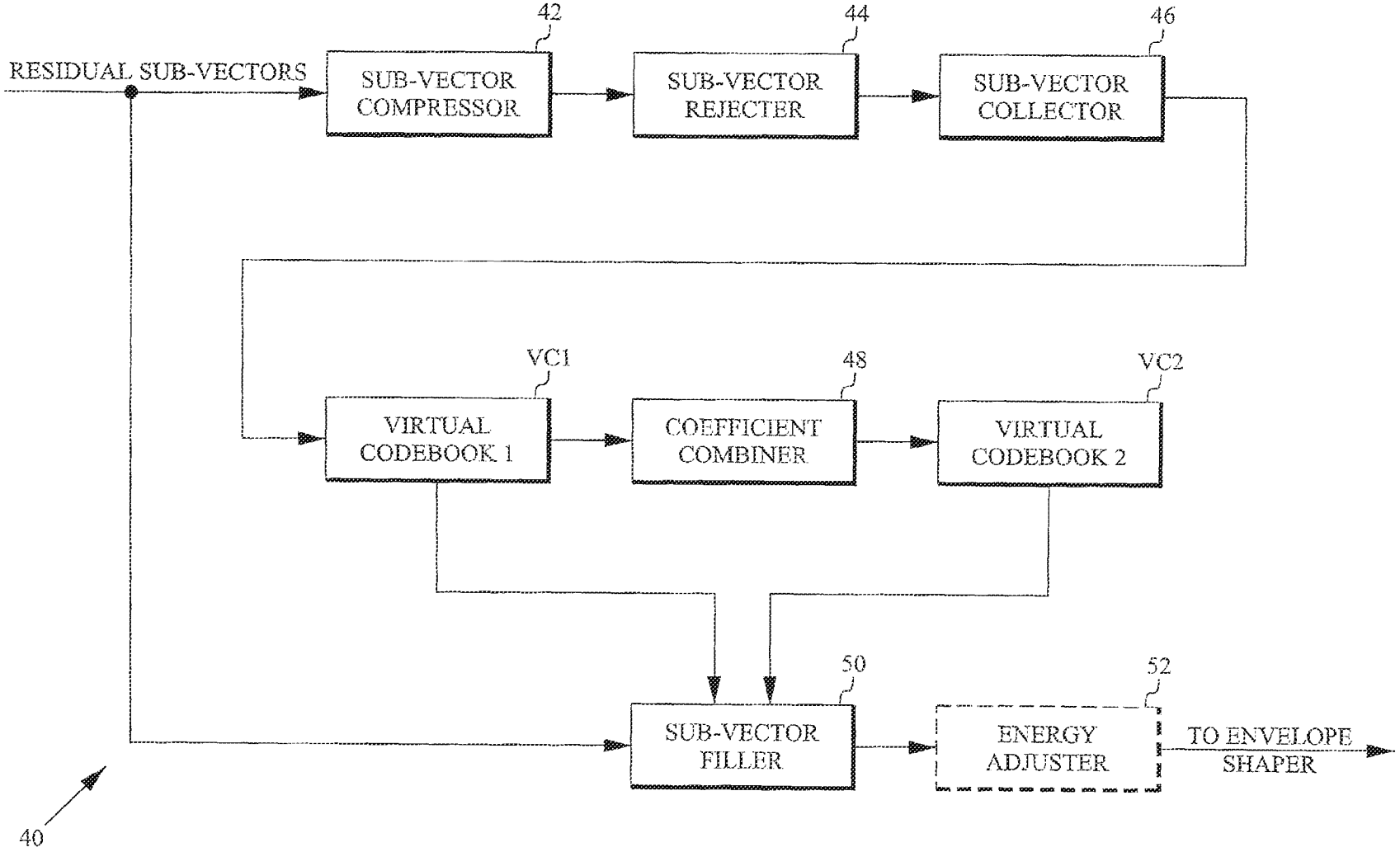
FIG. 12 is a block diagram illustrating an example embodiment of a spectrum filler.

FIG. 12 is a block diagram illustrating an example embodiment of a spectrum filler 40. Residual sub-vectors are forwarded to a sub-vector compressor 42, which is configured to compress actually coded residual sub-vectors (i.e., sub-vectors that have actually been allocated bits for coding), for example in accordance with equation (1). The compressed sub-vectors are forwarded to a sub-vector rejecter 44, which is configured to reject compressed residual sub-vectors that do not fulfill a predetermined sparseness criterion, for example criterion (3). The remaining compressed sub-vectors are collected in a sub-vector collector 46, which is configured to concatenate them to form a first (low frequency) virtual codebook VC1. Coefficients from the first virtual codebook VC1 are forwarded to a coefficient combiner 48, which is configured to combine pairs of coefficients to form a second (high frequency) virtual codebook VC2, for example in accordance with equation (5). Thus, up to this point the spectrum filler 40 includes the same elements as the high frequency virtual codebook generator 70. The residual sub-vectors are also forwarded to a sub-vector filler 50, which is configured to fill non-coded residual sub-vectors below a predetermined frequency with coefficients from the first virtual codebook VC1, and to fill non-coded residual sub-vectors above the predetermined frequency with coefficients from the second virtual codebook. In a preferred embodiment the spectrum filler 40 also includes an energy adjuster 52 configured to adjust the energy of filled non-coded residual sub-vectors to obtain a perceptual attenuation, as described above.

Figure 13:
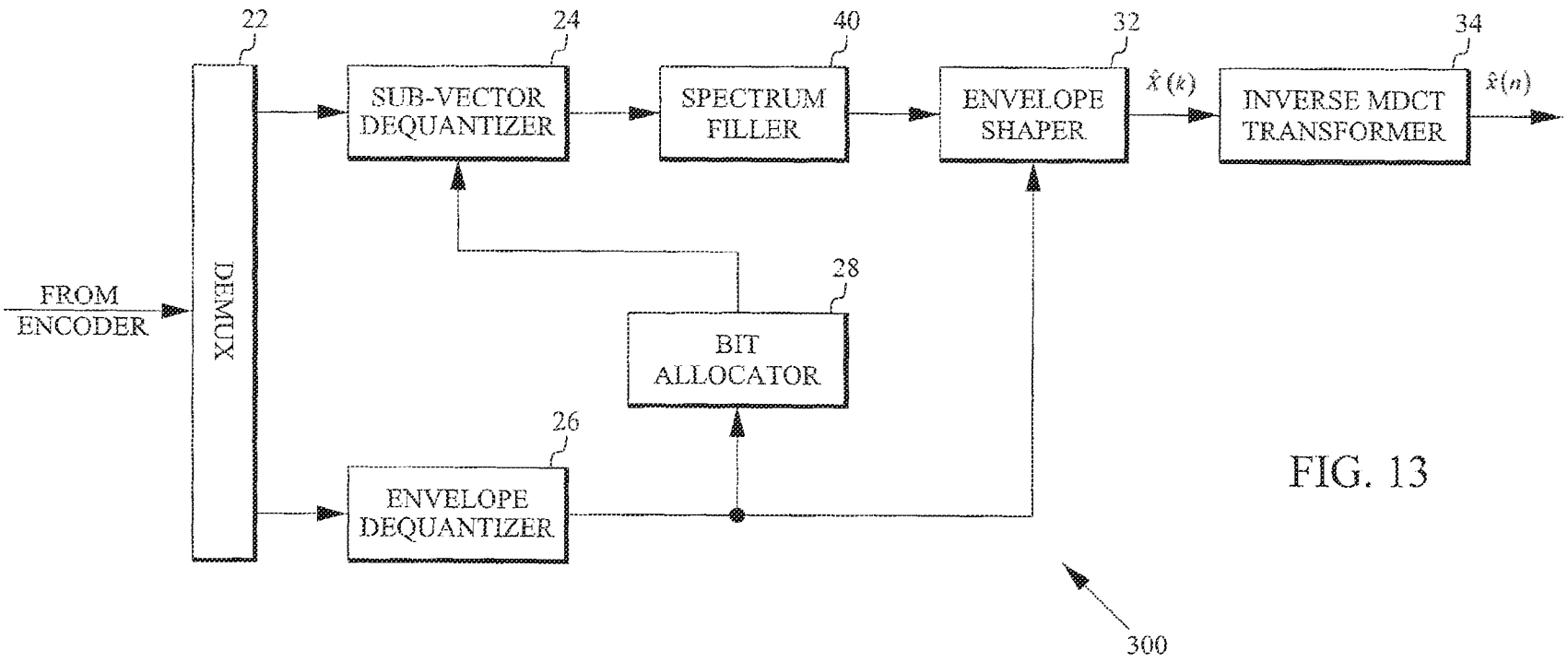
FIG. 13 is a block diagram illustrating an example embodiment of a decoder including a spectrum filler.

FIG. 13 is a block diagram illustrating an example embodiment of a decoder 300 including a spectrum filler 40. The general structure of the decoder 300 is the same as of the decoder in FIG. 1, but with the noise filler 30 replaced by the spectrum filler 40.

Figure 14:
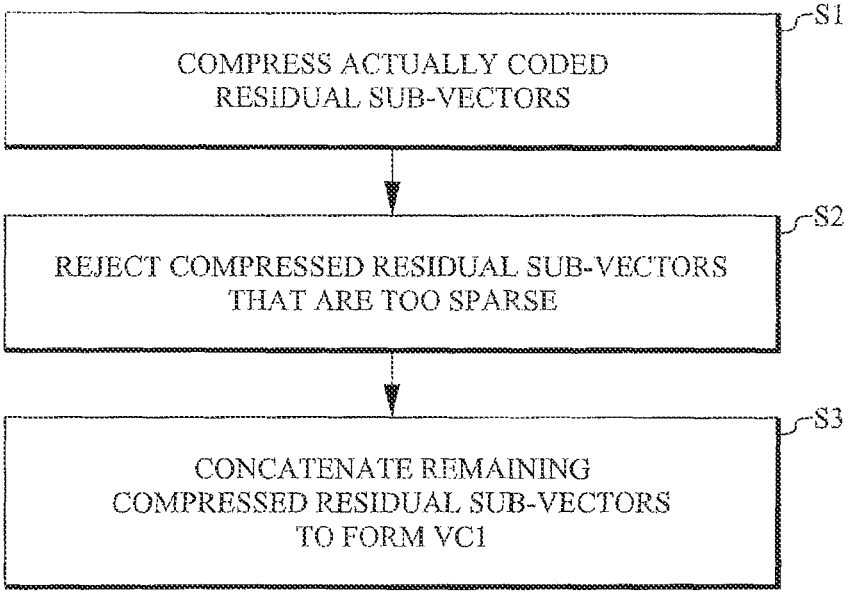
FIG. 14 is a flow chart illustrating low frequency virtual codebook generation.

FIG. 14 is a flow chart illustrating low frequency virtual codebook generation. Step S1 compresses actually coded residual sub-vectors, for example in accordance with equation (1). Step S2 rejects compressed residual sub-vectors that are too sparse, i.e., compressed residual sub-vectors that do not fulfill a predetermined sparseness criterion, for example criterion (3). Step S3 concatenates the remaining compressed residual sub-vectors to form the virtual codebook VC1.

Figure 15:
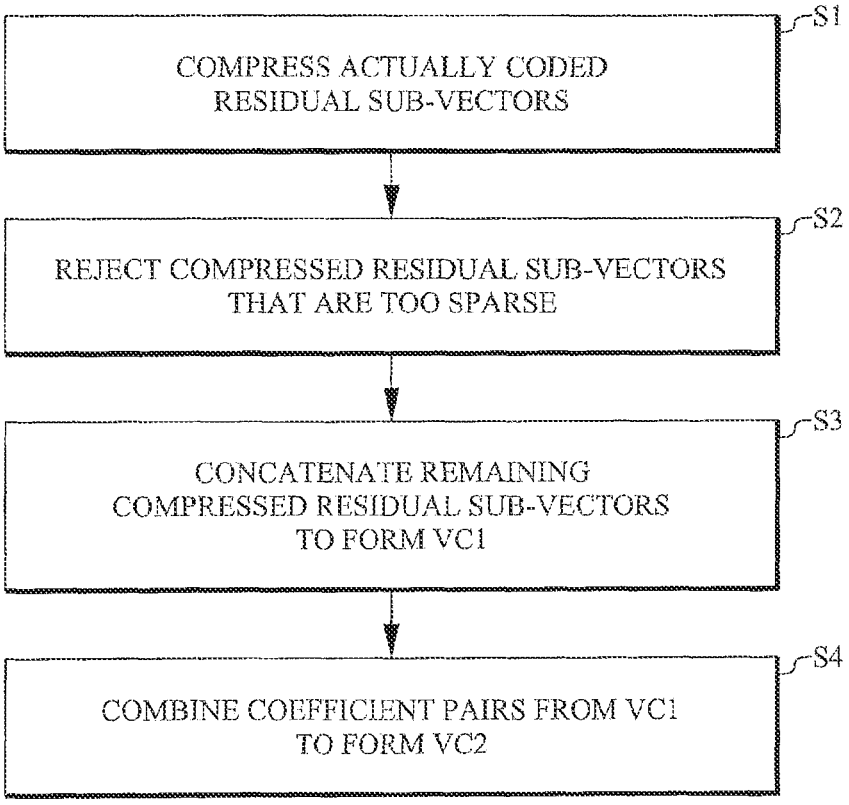
FIG. 15 is a flow chart illustrating high frequency virtual codebook generation.

FIG. 15 is a flow chart illustrating high frequency virtual codebook generation. Step S1 compresses actually coded residual sub-vectors, for example in accordance with equation (1). Step S2 rejects compressed residual sub-vectors that are too sparse. i.e., compressed residual sub-vectors that do not fulfill a predetermined sparseness criterion, such as criterion (3). Step S3 concatenates the remaining compressed residual sub-vectors to form a first virtual codebook VC1. Thus, up to this point the high frequency virtual codebook generation includes the same steps as the low frequency virtual codebook generation. Step S4 combines pairs of coefficients of the first virtual codebook VC1, for example in accordance with equation (5), thereby forming the high frequency virtual codebook VC2.

Figure 16:
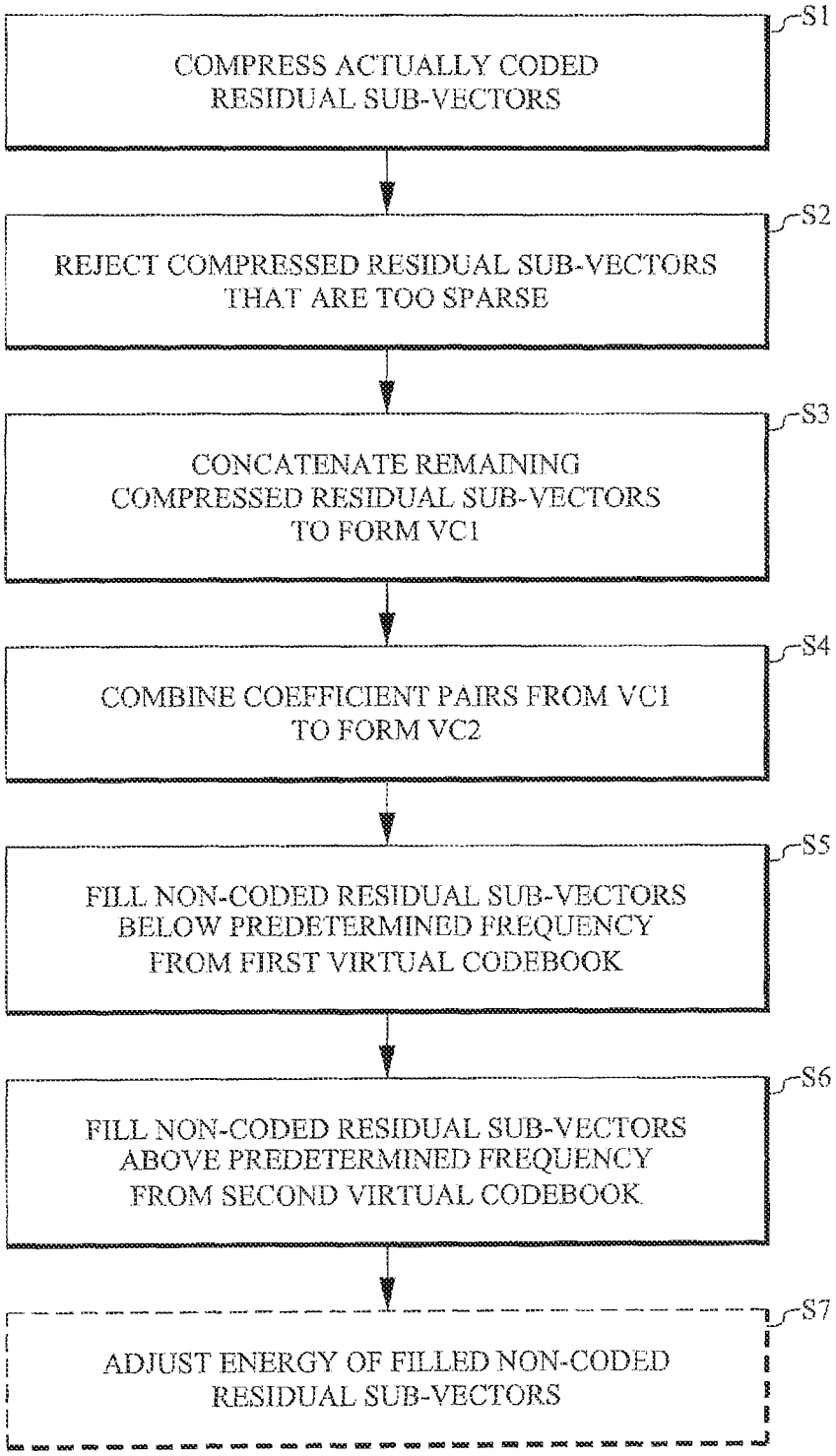
FIG. 16 is a flow chart illustrating spectrum filling.

FIG. 16 is a flow chart illustrating spectrum filling. Step S1 compresses actually coded residual sub-vectors, for example in accordance with equation (1). Step S2 rejects compressed residual sub-vectors that are too sparse, i.e., compressed residual sub-vectors that do not fulfill a predetermined sparseness criterion, such as criterion (3). Step S3 concatenates the remaining compressed residual sub-vectors to form a first virtual codebook VC1. Step S4 combines pairs of coefficients of the first virtual codebook VC1, for example in accordance with equation (5), to form a second virtual codebook VC2. Thus, up to this point the spectrum filling includes the same steps as the high frequency virtual codebook generation. Step S5 fills non-coded residual sub-vectors below a predetermined frequency with coefficients from the first virtual codebook VC1. Step S6 fills non-coded residual sub-vectors above a predetermined frequency with coefficients from the second virtual codebook VC2. Optional step S7 adjusts the energy of filled non-coded residual sub-vectors to obtain a perceptual attenuation, as described above.

Figure 17:
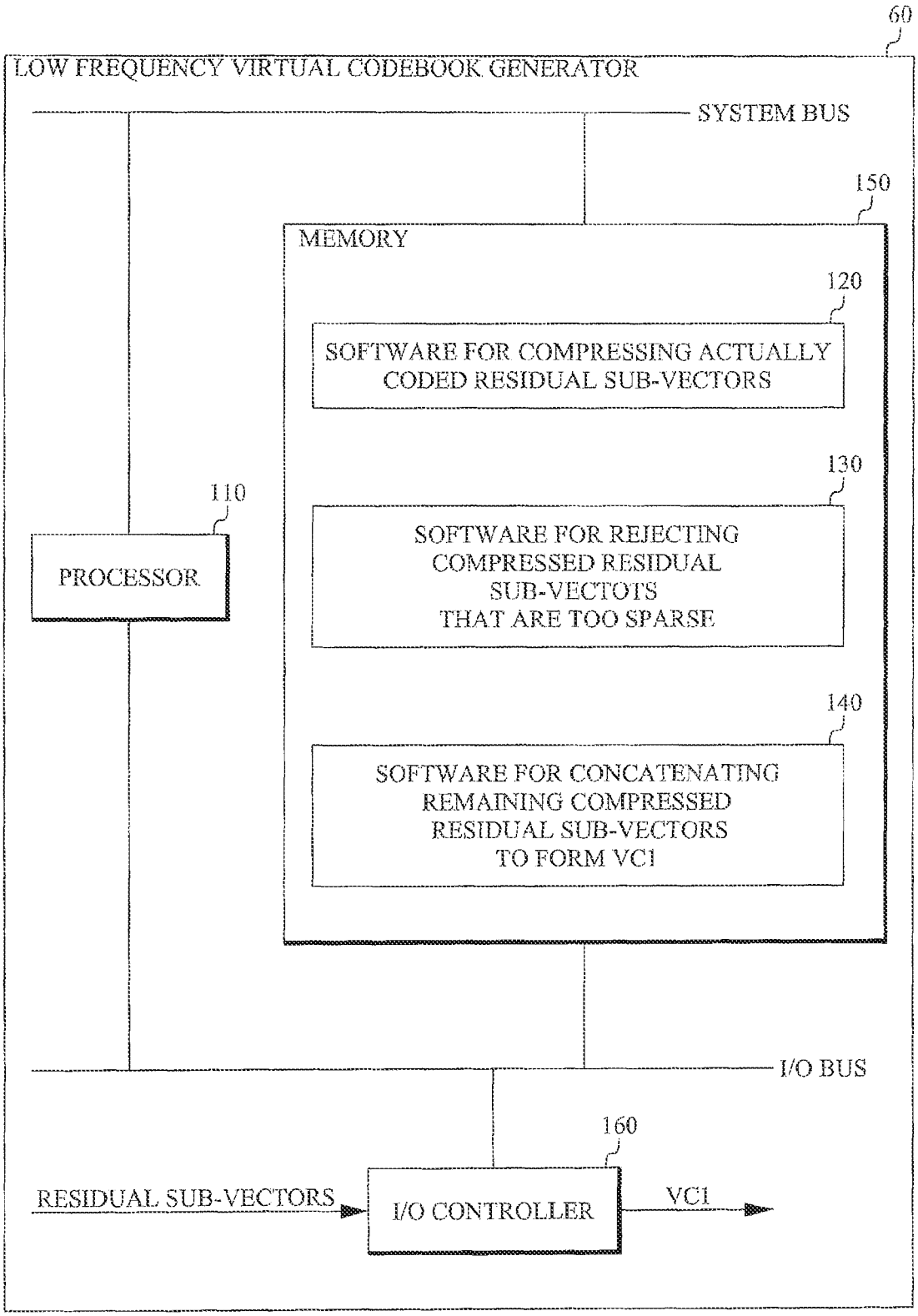
FIG. 17 is a block diagram illustrating an example embodiment of a low frequency virtual codebook generator.

FIG. 17 is a block diagram illustrating an example embodiment of a low frequency virtual codebook generator 60. This embodiment is based on a processor 110, for example a microprocessor, which executes a software component 120 for compressing actually coded residual sub-vectors, a software component 130 for rejecting compressed residual sub-vectors that are too sparse, and a software component 140 for concatenating the remaining compressed residual sub-vectors to form the virtual codebook VC1. These software components are stored in memory 150. The processor 110 communicates with the memory over a system bus. The residual sub-vectors are received by an input/output (I/O) controller 160 controlling an I/O bus, to which the processor 110 and the memory 150 are connected. In this embodiment, the residual sub-vectors received by the I/O controller 160 are stored in the memory 150, where they are processed by the software components. Software component 120 may implement the functionality of block 42 in the embodiment described with reference to FIG. 10 above. Software component 130 may implement the functionality of block 44 in the embodiment described with reference to FIG. 10 above. Software component 140 may implement the functionality of block 46 in the embodiment described with reference to FIG. 10 above. The virtual codebook VC1 obtained from software component 140 is outputted from the memory 150 by the I/O controller 160 over the I/O bus or is stored in memory 150.

Figure 18:
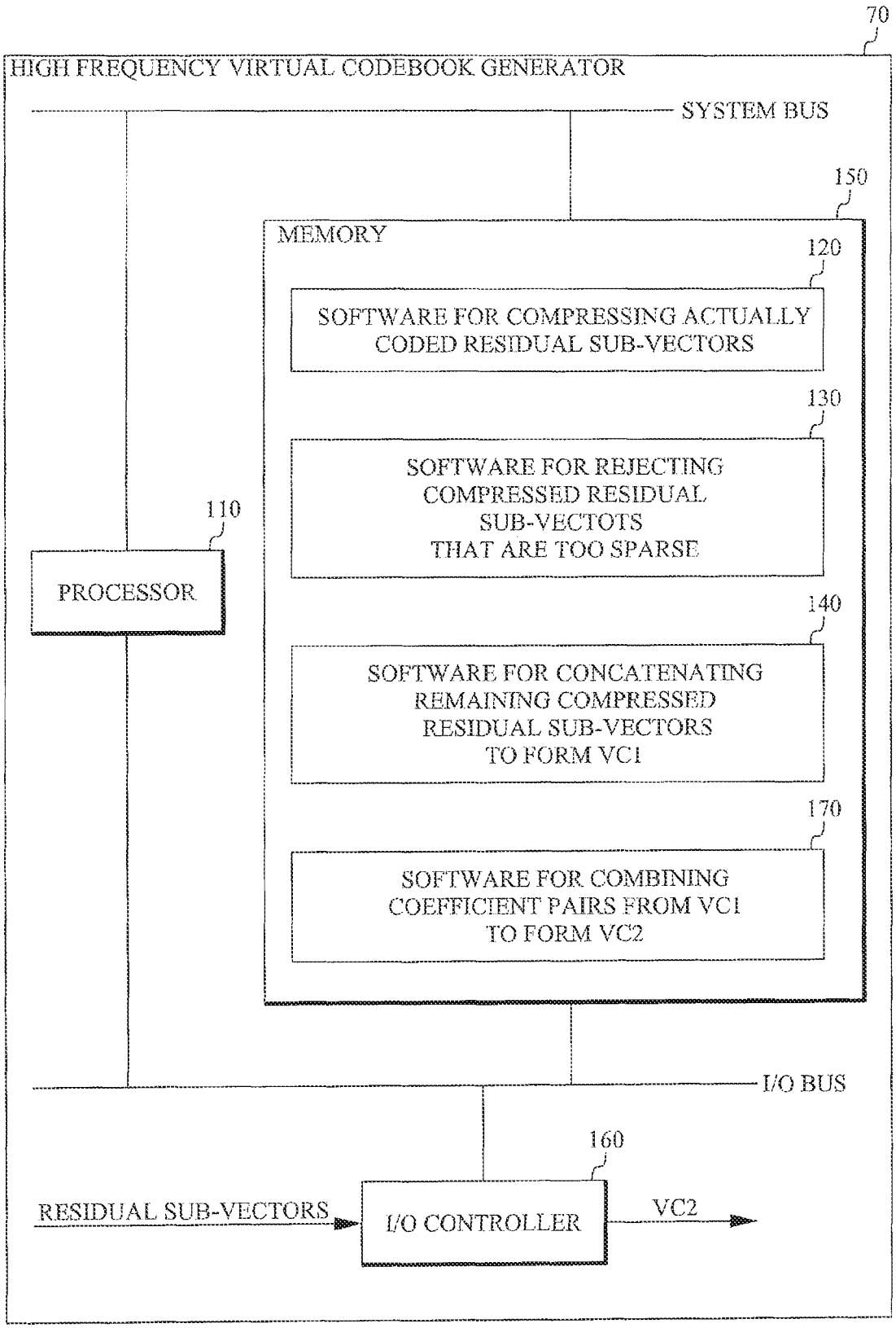
FIG. 18 is a block diagram illustrating an example embodiment of a high frequency virtual codebook generator.

FIG. 18 is a block diagram illustrating an example embodiment of a high frequency virtual codebook generator 70. This embodiment is based on a processor 110, for example a microprocessor, which executes a software component 120 for compressing actually coded residual sub-vectors, a software component 130 for rejecting compressed residual sub-vectors that are too sparse, a software component 140 for concatenating the remaining compressed residual sub-vector- to form low frequency virtual codebook VC1, and a software component 170 for combining coefficient pairs from the codebook VC1 to form the high frequency virtual codebook VC2. These software components are stored in memory 150. The processor 110 communicates with the memory over a system bus. The residual sub-vectors are received by an input/output (I/O) controller 160 controlling an I/O bus, to which the processor 110 and the memory 150 are connected. In this embodiment, the residual sub-vectors received by the I/O controller 160 are stored in the memory 150, where they are processed by the software components. Software component 120 may implement the functionality of block 42 in the embodiment described with reference to FIG. 11 above. Software component 130 may implement the functionality of block 44 in the embodiments described with reference to FIG. 11 above. Software component 140 may implement the functionality of block 46 in the embodiment described with reference to FIG. 11 above. Software component 170 may implement the functionality of block 48 in the embodiment described with reference to FIG. 11 above. The virtual codebook VC1 obtained from software component 140 is preferably stored in memory 150 for this purpose. The virtual codebook VC2 obtained from software component 170 is outputted from the memory 150 by the I/O controller 160 over the I/O bus or is stored in memory 150.

Figure 19:
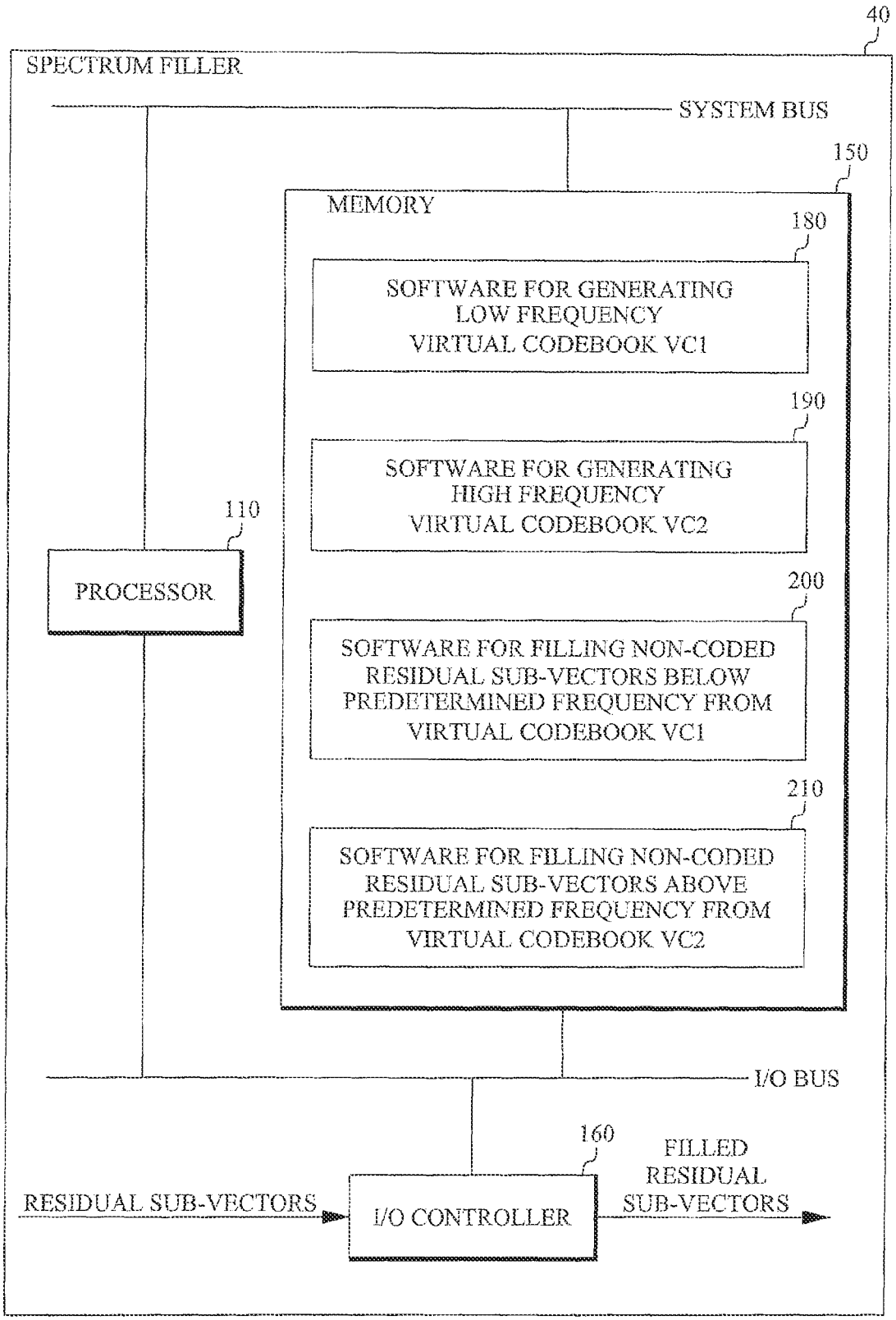
FIG. 19 is a block diagram illustrating an example embodiment of a spectrum filler.

FIG. 19 is a block diagram illustrating an example embodiment of a spectrum filler 40. This embodiment is based on a processor 110, for example a microprocessor, which executes a software component 180 for generating a low frequency virtual codebook VC1, a software component 190 for generating a high frequency virtual codebook VC2, a software component 200 for filling non-coded residual sub-vectors below a predetermined frequency from the virtual codebook VC1, and a software component 210 for filling non-coded residual sub-vectors above a predetermined frequency from the virtual codebook VC2. These software components are stored in memory 150. The processor 110 communicates with the memory over a system bus. The residual sub-vectors are received by an input/output (I/O) controller 160 controlling an I/O bus, to which the processor 110 and the memory 150 are connected. In this embodiment, the residual sub-vectors received by the I/O controller 160 are stored in the memory 150, where they are processed by the software components. Software component 180 may implement the functionality of blocks 42-46 in the embodiment described with reference to FIG. 12 above. Software component 190 may implement the functionality of block 48 in the embodiments described with reference to FIG. 12 above. Software components 200, 210 may implement the functionality of block 50 in the embodiment described with reference to FIG. 12 above. The virtual codebooks VC1. VC2 obtained from software components 180 and 190 are preferably stored in memory 150 for this purpose. The filled residual sub-vectors obtained from software components 200, 201 are outputted from the memory 150 by the I/O controller 160 over the I/O bus or are stored in memory 150.

The technology described above is intended to be used in an audio decoder, which can be used in a mobile device (e.g., mobile phone, laptop) or a stationary PC. Here the term User Equipment (UE) will be used as a generic name for such devices. An audio decoder with the proposed spectrum fill scheme may be used in real-time communication scenarios (targeting primarily speech) or streaming scenarios (targeting primarily music).

Figure 20:
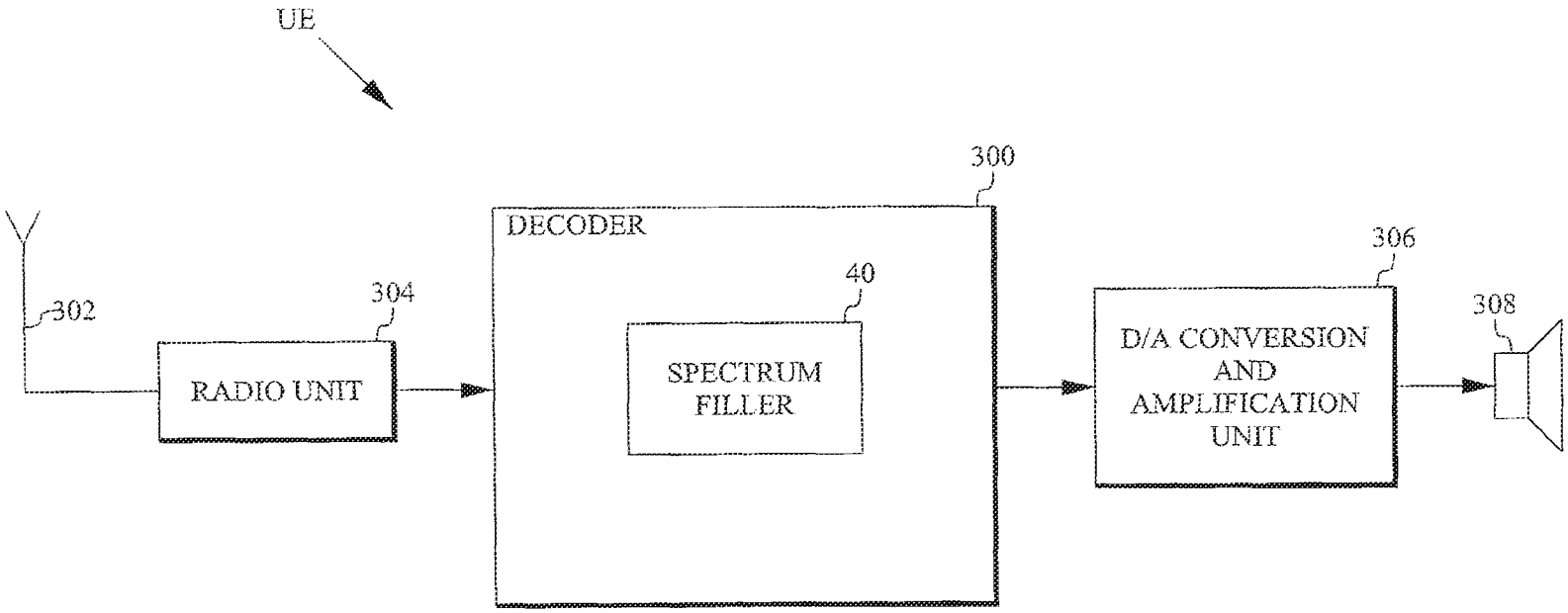
FIG. 20 is a block diagram illustrating an example embodiment of a user equipment.

FIG. 20 illustrates an embodiment of a user equipment in accordance with the present technology. It includes a decoder 300 provided with a spectrum filler 40 in accordance with the present technology. This embodiment illustrates a radio terminal, but other network nodes are also feasible. For example, if voice over IP (Internet Protocol) is used in the network, the user equipment may comprise a computer.

In the user equipment in FIG. 20 an antenna 302 receives an encoded audio signal. A radio unit 304 transforms this signal into audio parameters, which are forwarded to the decoder 300 for generating a digital audio signal, as described with reference to the various embodiments above. The digital audio signal is then D/A converted and amplified in a unit 306 and finally forwarded to a loudspeaker 308.

It will be understood by those skilled in the art that various modifications and changes may be made to the present technology without departure from the scope thereof, which is defined by the appended claims.

REFERENCES

[1] ITU-T Rec. G.719, "Low-complexity full-band audio coding for high-quality conversational applications." 2008, Sections 8.4.1, 8.4.3.

[2] Mittal, J. Ashley, E. Cruz-Zeno, "Low Complexity Factorial Pulse Coding of MDCT Coefficients using Approximation of Combinatorial Functions," ICASSP 2007

Abbreviations

FPC Factorial Pulse Coding
MDCT Modified Discrete Cosine Transform
RMS Root-Mean-Square
UE User Equipment
VC Virtual Codebook

What is claimed is:

1. A method of audio decoding, the method comprising:

receiving a bit stream conveying coded residual sub-vectors of a transform vector that encodes a time-domain frame of an audio signal, each residual sub-vector corresponding to a respective frequency band;

reconstructing the transform vector by decoding the coded residual sub-vectors and, for each frequency band for which no coded residual sub-vector was conveyed in the bit stream, forming a non-coded residual sub-vector using coefficients taken cyclically in frequency order from a first codebook if the frequency band is below a defined cutoff frequency and otherwise using coefficients taken cyclically in frequency order from a second codebook;

wherein the first and second codebooks are formed by:

compressing the decoded residual sub-vectors, rejecting ones among the compressed decoded residual sub-vectors that do not fulfill a sparseness criterion, and using coefficients from the remaining ones of the compressed decoded residual sub-vectors in frequency order to form the first codebook; and combining frequency-mirrored pairs of coefficients from the first codebook, to form the second codebook.

2. The method according to claim 1, further comprising generating a digital audio signal from the reconstructed transform vector.

3. The method according to claim 1, wherein the cutoff frequency is between 4 kHz and 6 kHz.

4. The method according to claim 1, wherein the cutoff frequency is 4.8 kHz.

5. The method according to claim 1, further comprising repeating the method with respect to further received coded residual sub-vectors corresponding to successive time-domain frames of the audio signal.

6. The method according to claim 1, wherein compressing the decoded residual sub-vectors comprises, for each decoded residual sub-vector, replacing each sub-vector element with a corresponding compressed value from a reduced set of compressed values that includes zero.

7. The method according to claim 6, wherein the sparseness criterion is fulfilled by any given decoded residual sub-vector that contains more than a defined minimum number of non-zero compressed values.

8. The method according to claim 7, wherein the defined minimum number of non-zero compressed values depends on the dimension of the decoded residual sub-vectors.

9. The method according to claim 6, wherein, for compression of a given decoded residual sub-vector, sub-vector elements within a defined range of zero are replaced with zero (0), sub-vector elements above the defined range are replaced with the value one (1), and sub-vector elements below the defined range are replaced with the value minus one (−1).

10. An audio decoder comprising:

interface circuitry configured to receive a bit stream conveying coded residual sub-vectors of a transform vector that encodes a time-domain frame of an audio signal, each residual sub-vector corresponding to a respective frequency band; and processing circuitry configured to:

reconstruct the transform vector by decoding the coded residual sub-vectors and, for each frequency band for which no coded residual sub-vector was conveyed in the bit stream, forming a non-coded residual sub-vector using coefficients taken cyclically in frequency order from a first codebook if the frequency band is below a defined cutoff frequency and otherwise using coefficients taken cyclically in frequency order from a second codebook;

wherein, to form the first and second codebooks, the processing circuitry is configured to:

compress the decoded residual sub-vectors, rejecting ones among the compressed decoded residual sub-vectors that do not fulfill a sparseness criterion, and using coefficients from the remaining ones of the compressed decoded residual sub-vectors in frequency order to form the first codebook; and combine frequency-mirrored pairs of coefficients from the first codebook, to form the second codebook.

11. The audio decoder according to claim 10, wherein the processing circuitry is configured to generate a digital audio signal from the reconstructed transform vector.

12. The audio decoder according to claim 10, wherein the cutoff frequency is between 4 kHz and 6 kHz.

13. The audio decoder according to claim 10, wherein the cutoff frequency is 4.8 kHz.

14. The audio decoder according to claim 10, wherein, with respect to further received coded residual sub-vectors received for respective ones among successive time-domain frames of the audio signal, the processing circuitry is configured to reconstruct the corresponding transform vectors.

15. The audio decoder according to claim 10, wherein, to compress the decoded residual sub-vectors, the processing circuitry is configured to, for each decoded residual sub-vector, replace each sub-vector element with a corresponding compressed value from a reduced set of compressed values that includes zero.

16. The audio decoder according to claim 15, wherein the sparseness criterion is fulfilled by any given decoded residual sub-vector that contains more than a defined minimum number of non-zero compressed values.

17. The audio decoder according to claim 16, wherein the defined minimum number of non-zero compressed values depends on the dimension of the decoded residual sub-vectors.

18. The audio decoder according to claim 15, wherein, for compression of a given decoded residual sub-vector, sub-vector elements within a defined range of zero are replaced with zero (0), sub-vector elements above the defined range are replaced with the value one (1), and sub-vector elements below the defined range are replaced with the value minus one (−1).

* * * * *